US008448464B2

(12) United States Patent
Varcin

(10) Patent No.: US 8,448,464 B2
(45) Date of Patent: May 28, 2013

(54) SET OF RINGS

(75) Inventor: Christian Varcin, La Chaux-de-Fonds (CH)

(73) Assignee: Lovekey Diffusion SA, La Chaux-de-Fonds (CH)

( * ) Notice: Subject to any disclaimer, the term of this patent is extended or adjusted under 35 U.S.C. 154(b) by 1182 days.

(21) Appl. No.: 11/734,023

(22) Filed: Apr. 11, 2007

(65) Prior Publication Data

US 2007/0186584 A1 Aug. 16, 2007

Related U.S. Application Data

(63) Continuation of application No. PCT/EP2005/054429, filed on Sep. 7, 2005.

(30) Foreign Application Priority Data

Oct. 15, 2004 (CH) ..... 01708/04

(51) Int. Cl.
*A44C 9/00* (2006.01)
*A44C 9/02* (2006.01)

(52) U.S. Cl.
USPC ..... 63/15.6; 63/15.1; 63/15.2; 63/15.3; 63/15.4

(58) Field of Classification Search
None
See application file for complete search history.

(56) References Cited

U.S. PATENT DOCUMENTS

| | | | | |
|---|---|---|---|---|
| 1,758,447 | A | 5/1930 | Liebs | |
| 3,483,717 | A * | 12/1969 | Mayer | 63/15.6 |
| 4,226,094 | A | 10/1980 | Wolpoff et al. | |
| 5,417,085 | A * | 5/1995 | Regev | 63/15.2 |
| 5,865,042 | A | 2/1999 | Cerqua et al. | |
| 6,484,536 | B1 * | 11/2002 | Gould | 63/15.1 |

FOREIGN PATENT DOCUMENTS

| | | |
|---|---|---|
| DE | 2516942 | 11/1976 |
| DE | 8704230 | 3/1987 |
| DE | 29814777 | 10/1999 |
| DE | 10238688 A1 | 3/2004 |
| EP | 0668033 A1 | 8/1995 |
| JP | 565214 | 8/1993 |
| JP | 2003299511 A | 10/2003 |

OTHER PUBLICATIONS

Notice of Reasons for Rejection dated Mar. 22, 2012, cited in JP Application No. 2007-536137.

* cited by examiner

*Primary Examiner* — Jack W. Lavinder
(74) *Attorney, Agent, or Firm* — Blank Rome LLP

(57) ABSTRACT

A set consisting of several pairs of rings (1, 2), wherein each ring has a single raised pattern (11, 21) enabling it to fit together with one other ring of the set. The raised pattern is, for example, arranged on the edge (10, 20) of each ring. The ring is mounted on an adaptation ring (3, 4) so that it can be adapted to the diameter of the wearer's finger. The individual ring pairs are manufactured with the aid of a cutting program on a digitally controlled machine.

29 Claims, 8 Drawing Sheets

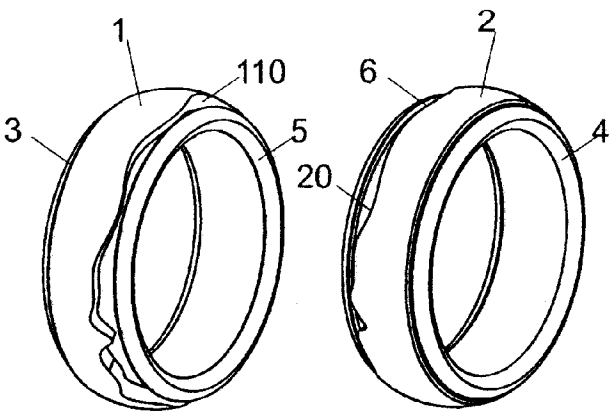
Fig.3C
Fig.3D
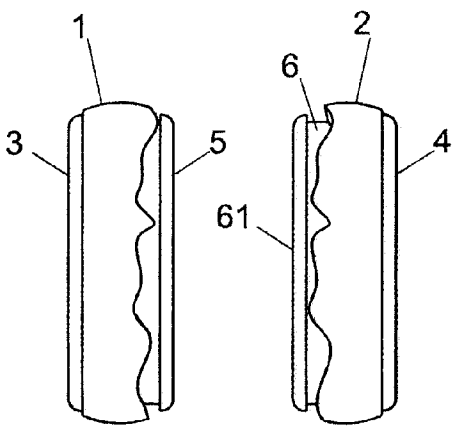
Fig.3E
Fig.3F
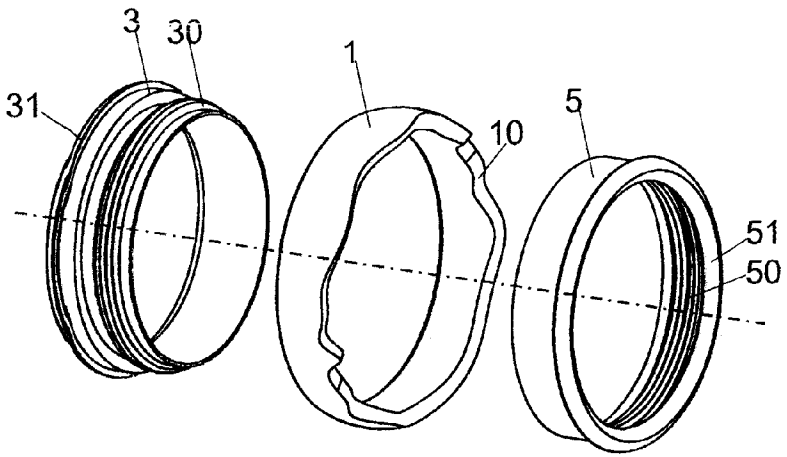
Fig.3A
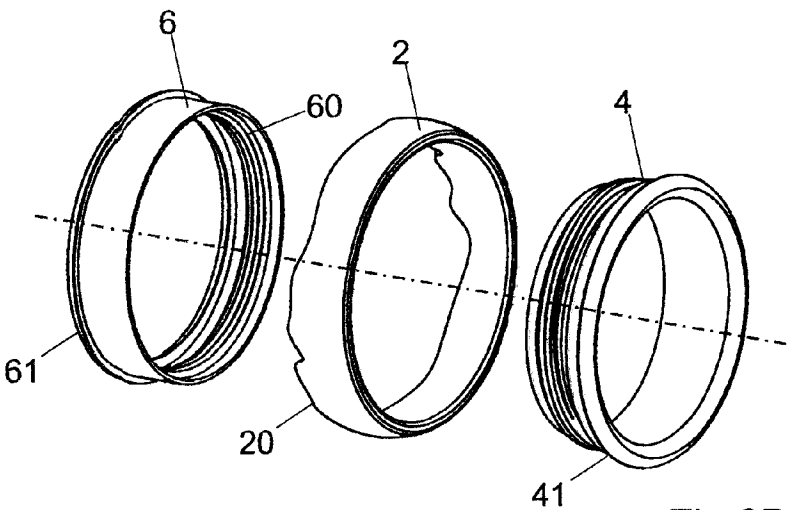
Fig.3B

COUPE A-A

SET OF RINGS

REFERENCE DATA

This application is a continuation of International Patent Application PCT/EP2005/054429 (WO2006/040224) filed on Sep. 7, 2005, claiming priority of Swiss patent application 2004CH-01708 of Oct. 15, 2004, the contents whereof are hereby incorporated.

FIELD OF THE INVENTION

The present invention concerns the field of jewelry, in particular the field of rings, as well as the manufacture of jewelry by machining.

DESCRIPTION OF RELATED ART

Many countries know the tradition of rings or wedding bands worn by the two members of a couple and designed to symbolize their union. The rings are for example exchanged during the engagement or the wedding ceremony. The engaged or married couple will then often chose similar or identical rings to mark their closeness. The rings are however generally not unique, so that each partner is linked at least symbolically to buyers, often unknown, who have chosen the same ring.

U.S. Pat. No. 1,758,447 (L. H. Liebs) describes a set of two rings produced by dividing a ring along its circumference along an arbitrary cutting line. The two rings resulting from this division are designed to be worn by the two members of a couple. By juxtaposing the two rings, the engaged or married couple can observe that the cutting line corresponds. The surname or first name of the two members of the couple can furthermore be engraved straddling the cutting line.

The two rings thus made from a single ring by necessity have the same diameter; they can thus be worn only by the members of a couple whose ring fingers have the same diameter, which is rarely the case.

Pairs of matching rings are also described in DE-U1-2981477.

Following the same principle, DE-U1-8704230 (P. Tiemann) describes two matching rings produced by splitting a ring having a tapered portion. It is thus possible to make two matching rings of different diameter. The junction portion of the small diameter ring is flared, which is rather unaesthetic. Furthermore, the diameter of the two related rings can no longer be modified after manufacture. A jeweler wishing to include this object in his stock must thus offer matching rings in a large number of possible size combinations.

One aim of the present invention is to propose rings and sets of rings allowing this tradition to be renewed.

Another aim is to propose sets of matching rings that can be adapted to the finger diameters for many couples.

BRIEF SUMMARY OF THE INVENTION

According to the invention, these aims are achieved notably by means of a set of rings having the characteristics of the main claim, with preferred embodiments being indicated in the dependent claims.

These aims are achieved in particular by means of a set having several pairs of rings, each ring having a pattern allowing it to be matched to a single other ring of said set. At least one ring has an interchangeable adapter for adapting its diameter to the wearer's finger.

The invention thus allows the unique relationship uniting the partners of each couple to be symbolized in a stronger manner. Each member of the couple is in fact linked to his partner by a matching pattern on his ring; no other ring can be matched to it. The two matching ring thus form a unique couple in which none of the members can be replaced without breaking the matching of the patterns.

The adapter makes it possible to machine pairs of rings of standard diameter that can be mounted on adapters to adapt their diameter to the wearers' fingers.

Ring diameter adapters as such are known. The adapters of known type are however not suited for matching rings of a pair; in particular, the varying matching profiles render difficult or even impossible the assembly of the rings of a pair onto standard adapters.

The patterns of the two matching rings are not necessarily identical; in a preferred embodiment, they are even different so that each ring is unique and provided with an individual pattern. The patterns of the two rings of a couple correspond however to one another in a manner that makes it possible to check that they match. In one embodiment, the patterns of the two members of the couple are inverted one in relation to the other.

In one embodiment of the invention, the two matching rings of a couple are provided with raised patterns that interlock with one another or that butt one against the other, each patterns being however individual so that a ring can only interlock in the matched ring of the same pair.

The matching of two rings can preferably be observed visually when the two rings are superimposed coaxially, for example when they are slipped onto the same finger or onto a same adaptation ring. In this position, the profiles of the two matching rings correspond to one another or allow the two rings to butt one against the other.

BRIEF DESCRIPTION OF THE DRAWINGS

The invention will be better understood by reading examples of embodiments illustrated by the figures, which show:

FIG. A1 to 1E a pair of two matching rings both mounted onto diameter adaptation rings, both rings having raised patterns comprising a sequence of convex and concave portions.

FIG. 3A to 3F a pair of two matching rings both mounted onto diameter adaptation rings in two parts.

DETAILED DESCRIPTION OF THE INVENTION

Figure 1A:
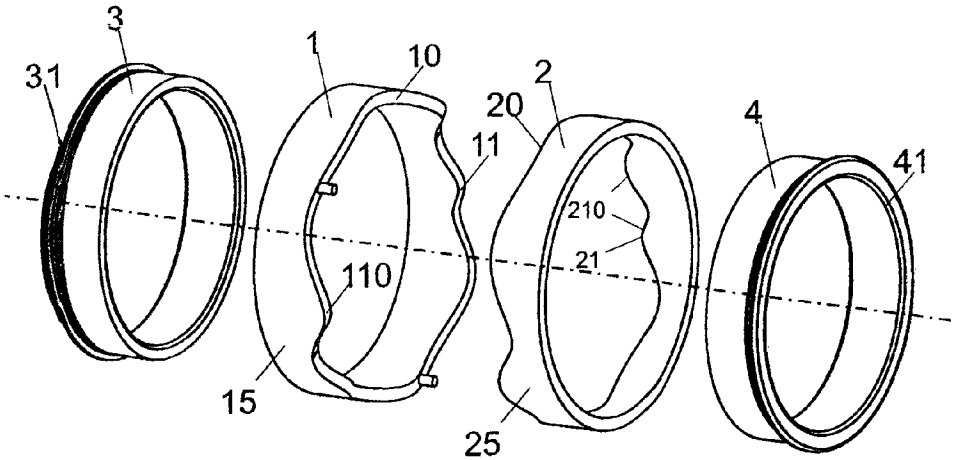

FIG. 1A illustrates in perspective a pair of matching rings that for example belong to a set having several pairs of rings that are all different from one another. The illustrated pair includes two rings 1 resp. 2, each provided with an edge 10 resp. 20 with profiles 11 and 12 corresponding to one another. The rings 1 and 2 are preferably monolithic and of metal, for example of precious metal, the invention being however not restricted to this particular choice. The ring can be of any shape and can be provided with stones or other patterns or decorations, notably on its outer side 15 resp. 25.

The two profiles 11 and 21 are constituted of a sequence of raised convex portions 110 resp. 210 and of concave portions 111 resp. 211. In the illustrated embodiment, the profiles 11 and 21 are defined by a mono-dimensional function f(Θ) of a single variable Θ corresponding for example to the angular position relative to the ring's center. Multidimensional profiles, depending for example on the distance to the ring's center, can also be conceived; it is for example possible to use beveled edges 10, 20 with varying bevel angles along the ring's periphery.

The raised pattern on the edge of each ring is unique. For example, the number of convex or concave portions, the width or height of these portions as well as their shape can vary. Prototypes have shown that even difference in the profile dimension on the order of the tenth of millimeter will cause a perceptible play during abutment, making the number of possible combinations practically unlimited. The chosen profile is however preferably void of discontinuities and of sharp angles likely to injure the ring's wearer and to accumulate impurities.

Figure 1C:
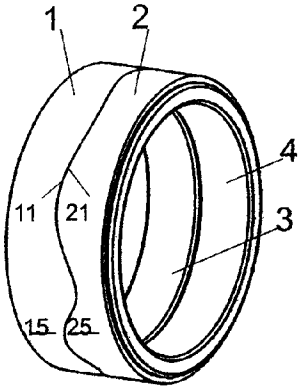
Figure 1D:
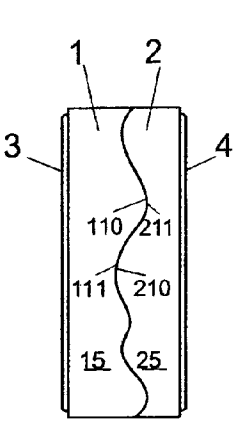
Figure 1E:
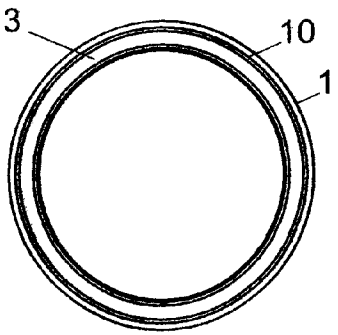
Figure 1B:
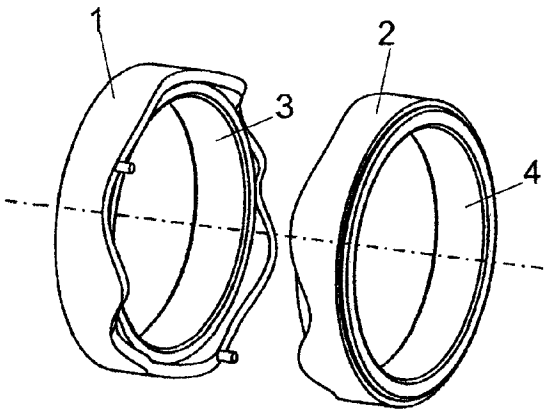

The matching of the two rings 2, 3 can be easily observed when the two rings are superimposed coaxially, as illustrated in FIGS. 1C and 1D. In this position, the profiles 11, 21 allow the two rings to abut into one another, both matching patterns fitting together against each other without play, in the manner of two parts of a puzzle. The two profiles 11 and 21 are thus not identical, but inverted in relation to one another.

The rings can also be provided with matching patterns on their outer sides 15, 25 or inner sides. For example, the rings can comprise a reconstituted inscription, drawing or raised pattern that can be deciphered when the two rings are superimposed as in the FIGS. 1C and 1D. In another embodiment, observing the matching between two rings can also be made by juxtaposing two rings against one another, i.e. by pressing portions of the outer surfaces 15, 25 of both rings against one another. This embodiment allows the matching of two rings to be observed without removing them from the two partners' fingers. It is also possible to wear a pair of matching rings in this fashion on two neighboring fingers of the same wearer. One ring can also bear one or several matching patterns on several distinct surfaces.

In another embodiment, the matching of the two rings can be observed by making the outer side of the smaller ring correspond to the inner side of the larger ring. This solution is however conceivable only if the diameter difference between the two rings of the couple is sufficient.

The rings 1, 2 can be custom made for each couple, depending on their finger diameter and by using at least one parameter defining the unique profile used. In one preferred embodiment, the pairs of rings of standard diameter are made in advance and designed to be sold to non-identified users. In this case, all the rings preferably have a radius r equal to the level of the edge 10, 20. It is thus possible to observe their matching more easily. Sets of rings having two or several standard ring diameters can however also be conceived; in this case, it is also possible to have the profiles of rings of different diameters correspond within a pair.

The variant embodiment illustrated in FIGS. 1A to 1E uses adaptation rings 3 resp. 4 to adapt the inner diameter of the rings 1 resp. 2 to the wearer's finger. The adaptation rings 3, 4 are inserted inside the outer rings 1, 2 and held for example by pressing, crimping, riveting, screwing, clicking, welding or gluing. A couple wishing to acquire a pair of rings 1, 2 thus selects a pair of rings of standard radius with an individual raised pattern 11, 21 and a general pattern that suits it, then reduces the radius of both rings 1, 2, by means of the adaptation rings of inner radius depending on the diameter of the fingers of both partners. The fastening mode of the adaptation rings preferably allows them to be mounted in a jeweler's shop with a minimum of tooling and by reducing the risk of deterioration of the ring's appearance during fitting. The adaptation rings 3, 4 can be provided with stops 31 resp. 41 to reduce the risk of coming unfastened and improve the finishing of the complete ring.

Figure 2A:
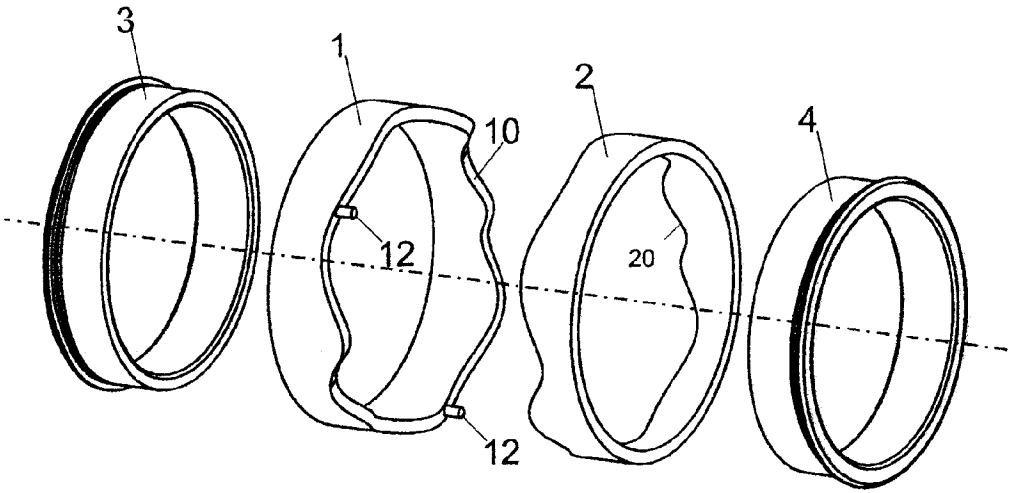
FIG. 2A to 2B a pair of matching rings having raised patterns comprising male and/or female elements that interlock with one another.
Figure 2B:
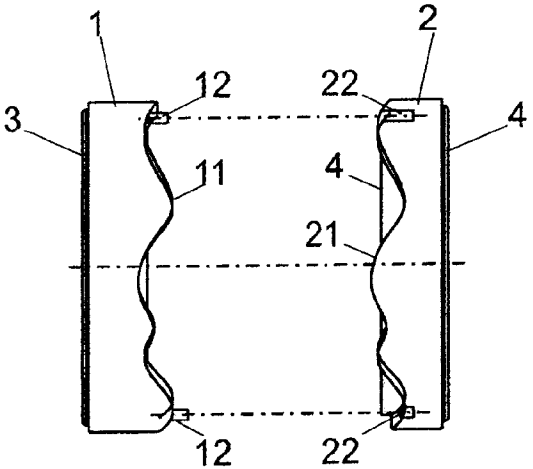

FIGS. 2A and 2B illustrate another embodiment of the invention, in which the individual pattern of each ring comprises male elements 12 and/or female elements 22.

The male pins 12 of a ring insert only in the female blind holes 22 of the other ring.

The number, angular position, shape and/or depth of the male elements and of the corresponding female elements are individual for each pair of matching rings, so that the male elements of a ring insert only in the female elements of the matching ring.

In the example illustrated, all the pins 12 are arranged on the ring 1—for example the man's ring—whilst the holes 22 are all arranged on the other ring 22. It is however naturally also possible to distribute the holes and pins on both rings. Furthermore, it is possible to use the pins or other types of male and female elements on rings whose edge 10/20 is not individualized, for example on rings whose two edges have an identical flat profile.

FIGS. 3A to 3F illustrate a variant embodiment of the invention in which the two rings 1 resp. 2 of a couple are mounted on adaptation rings 3, 5 resp. 4, 6 constituted of two threaded parts screwed one to another through the rings. The references 30, 40, 50, 60 illustrate the inside or outside threading of the different parts. The ring 1 resp. 2 can preferably be pivoted between a first stop (31 resp. 61) connected to the first part (3 resp. 6) and a second stop (41 resp 51) connected to the second part (4 resp. 5), with stops restricting the lateral displacement of the rings 1, 2. This variant has the advantage of avoiding contact between the profiled flanks 10, 20 and the wearer's skin; it is thus possible to use sharper profiles without risk of injury. Furthermore, the mounting or disassembling of the ring on the adaptation ring is made easier.

Figure 4A:
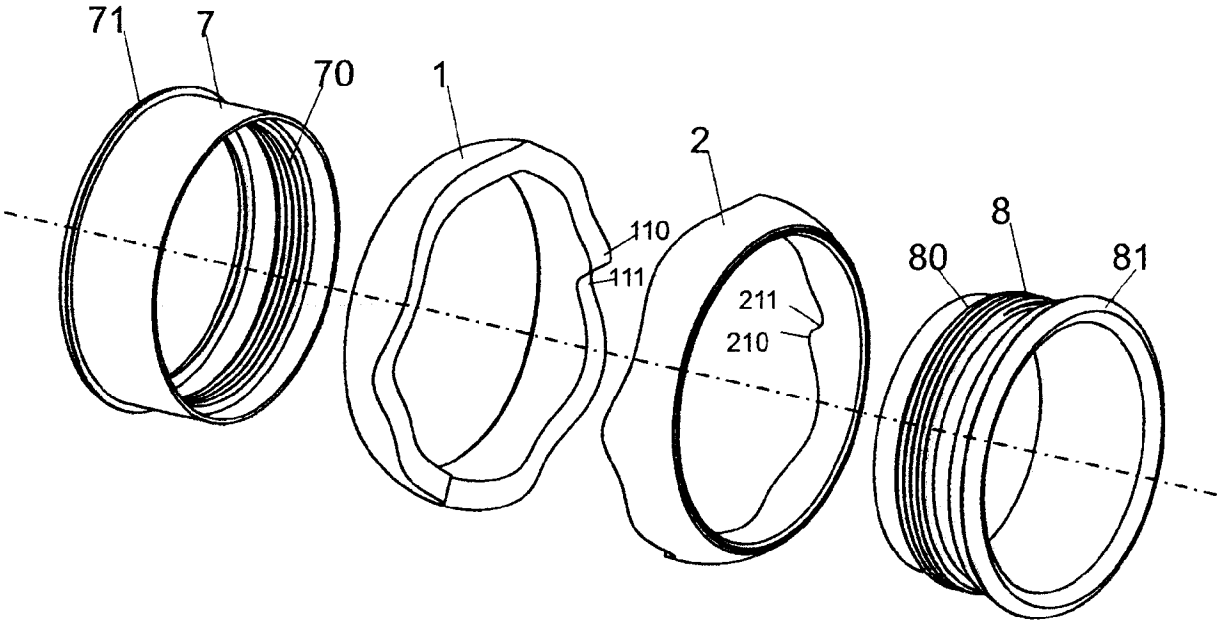
FIG. 4A to 4B a pair of two matching rings both mounted onto the same diameter adaptation ring.
Figure 4B:
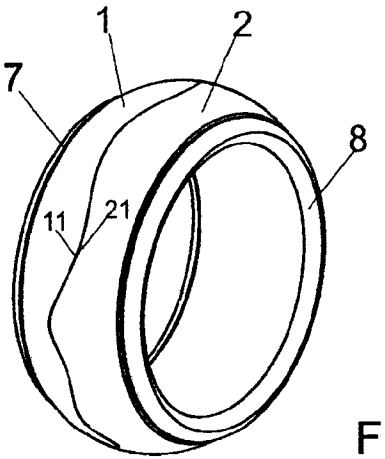

FIGS. 4A and 4B illustrate a variant embodiment of the invention in which the two matching rings 1, 2 of a same pair are worn on the same finger and mounted on a same adaptation ring, here an adaptation ring constituted of two parts 7, 8 linked to one another by means of a threading 70, 80. This solution is appropriate for example for a single person still seeking its soul mate or for a widower/widow who wishes to keep the souvenir of a lost spouse. In one embodiment, it is also possible to make two pairs of rings 1, 2 with profiles 11, 21 that are identical two to two but for example in different colors or materials. During the engagement or for the wedding, the two partners exchange one element of their pairs and reconstitute a complete two-color or bi-metallic pair that they can wear on the same finger. In this case, each ring can thus be matched to two rings of a set.

Figure 5A:
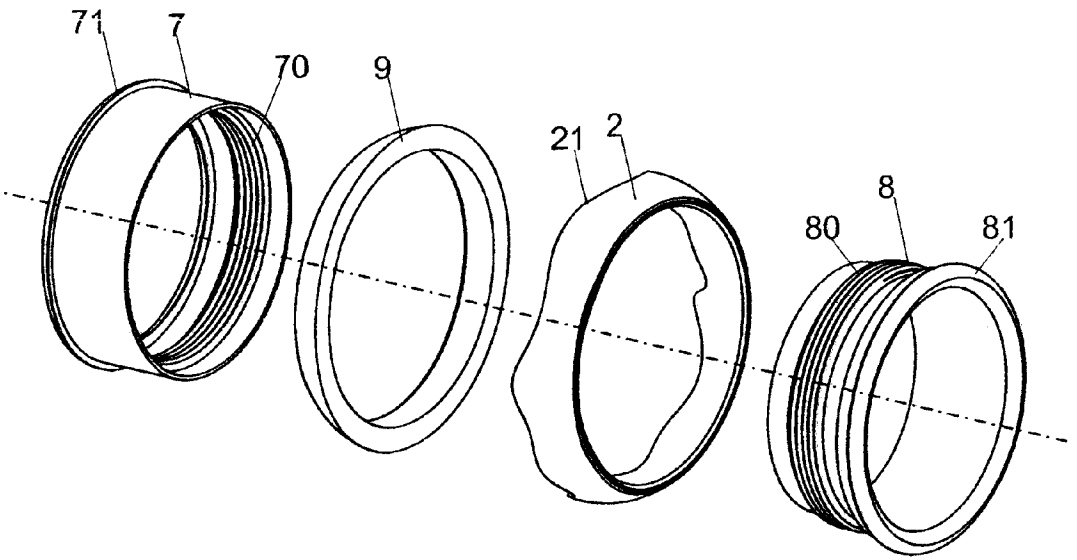
FIG. 5A to 5C a ring having a pattern allowing it to be matched to a ring, not represented, and mounted onto an adaptation ring with a neutral counterpart.
Figure 5C:
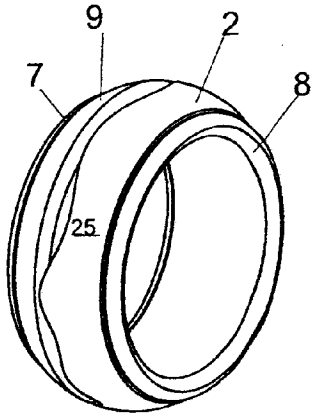
Figure 5B:
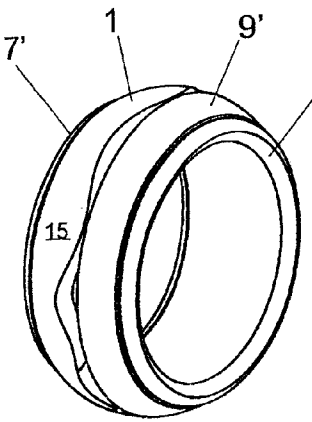

FIGS. 5A to 5C illustrate a variant embodiment of the invention in which each ring 1, 2 is mounted with a neutral counterpart 9, 9' on a coupling ring 7, 8 resp. 7', 8', here a two-part ring. The rings 1, 2 are individual and provided each with a unique profile. The counterparts 9, 9' are however interchangeable and exist in a limited number of embodiments. This solution is adapted for example to a single person who buys the pair of rings of FIG. 4 with the adaptation ring allowing both rings of this pair to be worn. Upon meeting a soul mate, half of the ring is given with an appropriate adaptation ring and the given half-ring is replaced by a standard counterpart 9 or 9'.

Figure 6A:
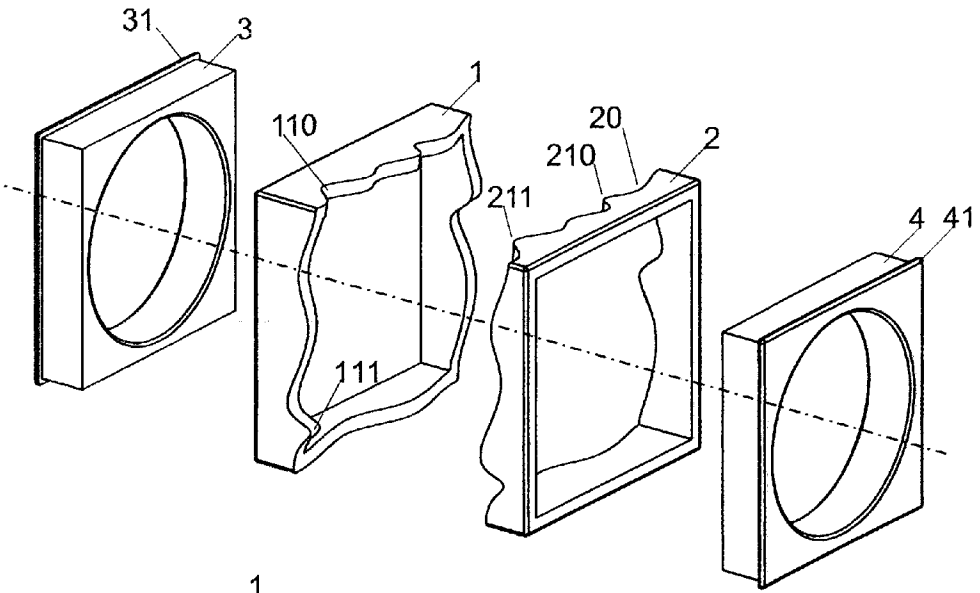
FIG. 6A to 6C a pair of two matching rings that are not circular, both mounted onto diameter adaptation rings, both rings having raised patterns comprising a sequence of convex and concave portions.
Figure 6B:
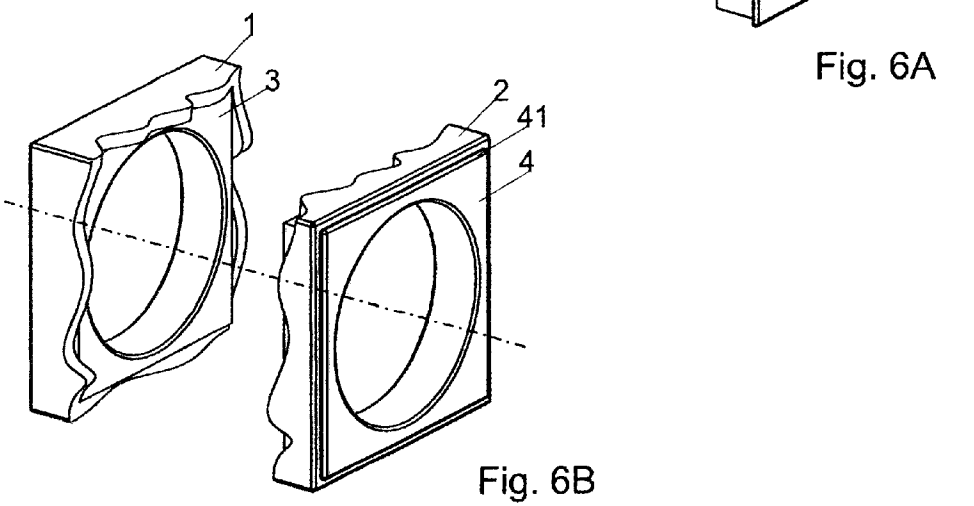
Figure 6C:
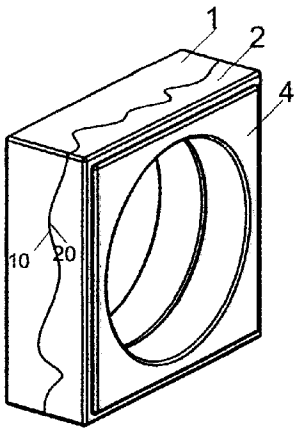
Figure 7A:
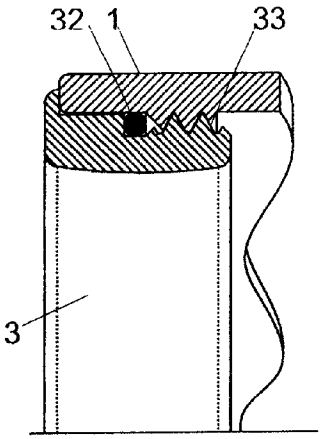
FIG. 7A to 7D a pair of matched rings screwed onto diameter adaptation rings.
Figure 7B:
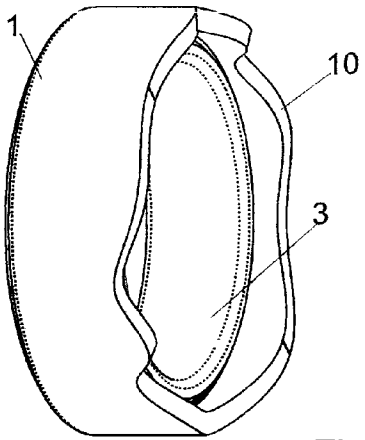
Figure 7C:
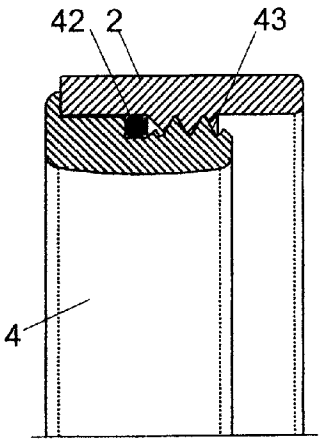
Figure 7D:
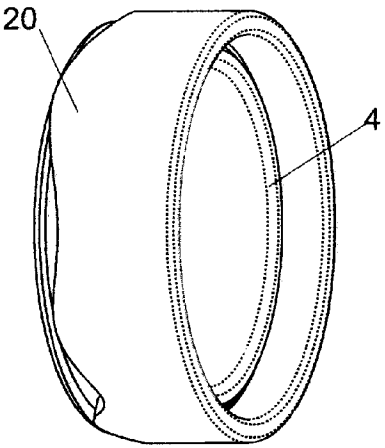
Figure 8C:
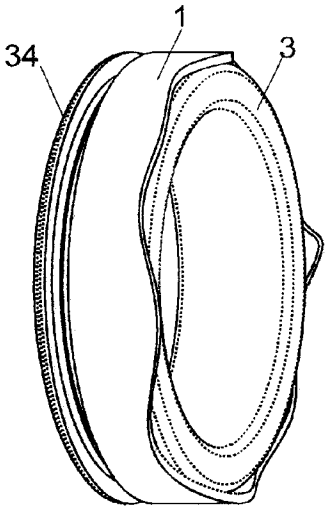
FIG. 8A to 8F a ring designed to be matched with the other ring of a pair and mounted in a sliding manner onto a diameter adaptation ring so as to make it possible to check that they match without disassembling the ring.
Figure 8F:
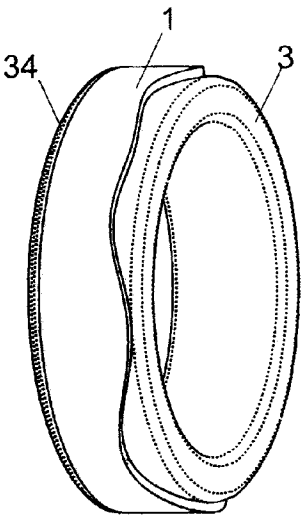
Figure 8B:
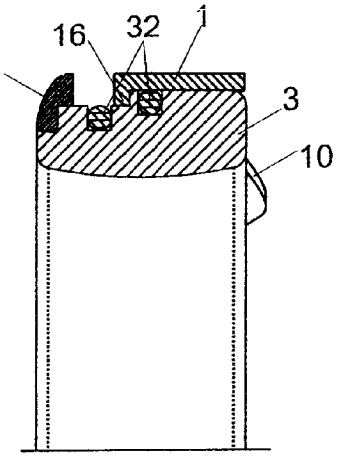
Figure 8E:
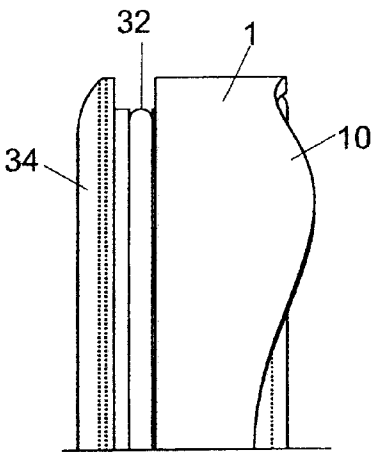
Figure 8A:
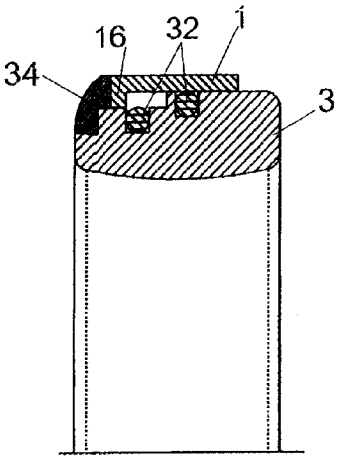
Figure 8D:
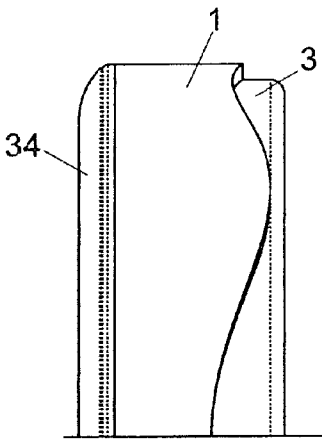

FIGS. 6A to 6*b* illustrate an embodiment of the invention in which the two rings 1, 2 have a non-circular shape, here a square outer shape. The rings are mounted around adaptation rings 3, 4 whose outer shape is compatible with the inner shape of the ring 1, 2 and the diameter of the central hole is adapted to the wearer's finger. Other ring shapes, including rings of fanciful shape or provided with stones, are conceivable within the frame of the invention.

FIGS. 7A to 7D illustrate an embodiment of the invention in which the two rings 1, 2 of a pair are screwed on the corresponding adaptation rings. An O-ring 32 resp. 42 is placed between the ring and the adaptation ring, so as to control the torque required for unscrewing the ring. An annular stop on each adaptation ring prevents the ring from being inserted or extracted from one of the sides of the adaptation ring.

FIGS. 8A to 8F illustrate an embodiment of the invention in which at least one of the rings 1 of a matched pair is mounted in sliding fashion onto the corresponding adaptation ring 3. An inside stop 16 on the ring 1 limits the amplitude of the displacement in the direction where the two rings move together. Another removable stop 34, screwed onto the adaptation ring 3, limits the amplitude of the displacement in the opposite direction. The stop 34 can be dismounted for assembling or removing the ring 1 from its adaptation ring 3. 0-rings 32 further allow the friction coefficient between the ring and the adaptation ring to be controlled, so as to avoid undesirable displacements. The ring is represented in closed position in FIGS. 8A, 8D and 8F and in open position in FIGS. 8B, 8E and 8C. The open position, in which the O-rings are hidden, is used for wearer the ring on a daily basis; the ring 1 will be moved to the closed position to check whether it matches other rings.

The two individual rings of a pair are preferably sold simultaneously, for example in the same jeweler's shop. When sold, they can be linked to one another by a suitable packaging, box or display case, making it possible to limit the risk of two members of a pair being separated from one another and mixed among other non-compatible rings of a set. In one embodiment, the two rings 1, 2 are linked mechanically to one another, for example by gluing by means of wax, or another easy to clean glue, or by a zone to be broken. When the rings are exchanged, the two partners must then break this link to separate the two rings that they will each wear.

It is also possible to provide each ring with a number or a code allowing the corresponding partner to be found easily. The two matching rings of a same pair can for example bear the same code completed by a letter or an information element that allows them to be differentiated. The number or code can for example be engraved inside the ring or marked non-permanently on a portion of the ring or on a label. In a preferred embodiment, the code is indicated on a certificate supplied to the buyer or stored in a database so as to be able to be found again even if the associated ring is lost. The code preferably contains the machining parameters of the ring's personal profile 11, 21 or in any case allows these parameters to be retrieved. It is thus possible to manufacture again at any time from this number or code a ring 1, 2 that has been lost or to replace a ring by a more modern ring without losing its compatibility with the previous ring.

In one variant embodiment of the invention, the individual pattern of each ring is constituted by a unique directly fastened part mounted on a standard ring. It is thus possible to manufacture pairs of individual parts, matching two to two, and fastened by any means onto rings of variable diameters adapted to different finger diameters.

As has been mentioned, the rings or jewelry of the invention are preferably made by digital control machines executing a cutting program. The cutting program determines the individual profile of each successive 1, 2 jewelry, so that each jewelry comprises a raised pattern allowing it to be matched with a single other produced jewelry. The profile 11, 21 generated for each jewelry pair depends on at least one parameter of the cutting program different for each piece of jewelry. The successive parameters are generated by a mathematical series, for example a semi-random number generator generating a sufficient or even infinite series of different numbers or from a predefined table of different numbers from one another or from the date and time of the manufacture. In one variant embodiment, the profiles 11, 21 of a pair are determined by means of parameters allowing only each couple to be identified, for example from the name of the two members of the couple and/or their birth date and/or their astrological sign and ascendant, etc. This variant however implies that these parameters should be known before the jewel or the jewelry's personalized pattern is manufactured.

The jewelry can also be made with the aid of several cutting machines using the same cutting program with different sequences of parameters. The different machines can for example use an identical pseudo-random number generator initialized with a value (seed) different on each machine.

The above description concerns systematically rings worn by couples formed of two partners. It is obviously also possible within the frame of the invention to conceive rings designed to be worn by groups of more than two members, the rings of all the members being matched to one another. It is also possible to conceive rings having more than two matching patterns—for example a pattern on each edge. Furthermore, it is also possible to match a unique ring with several compatible rings, identical to or different from one another, in the case of polygamy or polyandry for example.

The invention claimed is:

1. Set of rings having several pairs of rings, each ring having a pattern allowing it to be matched to a single other ring of said set, at least one of the rings in the set of several pairs of rings, having an interchangeable adapter, wherein at least a part of the interchangeable adapter is inserted inside the ring to adapt an inside diameter of the ring to the wearer's finger so that the at least one ring is individually adapted to fit the wearer's finger, and wherein the at least one ring has a first outer side and a second outer side opposite the first outer side, that the pattern is located at the first outer side and wherein the adapter is configured to engage the at least one ring at the second outer side and to leave the first outer side exposed so that pattern on the first outer side can cooperate with the pattern of a matching ring.

2. Set of rings according to claim 1, said ring being screwed, pressed, welded, crimped, riveted or glued onto said adapter.

3. Set of rings according to claim 1, said ring comprising an inner circumferential side, said adapter comprising an outer circumferential side, said ring and said adapter being held fixedly united with one another at a level of said inner circumferential side and said outer circumferential side.

4. Set of rings according to claim 1, wherein at least a portion of an outer diameter of said adapter is less than the inside diameter of said ring.

5. Set of rings according to claim 1, at least one ring joint being provided between said adapter and said ring.

6. Set of rings according to claim 1, further comprising a stop making it possible to prevent the ring from being inserted or extracted from only one of two sides of the associated adapter.

7. Set of rings according to claim 6, said stop being removable.

8. Set of rings according to claim 1, said adapter having two parts linked to one another so as to hold said ring between a first stop linked to the first part and a second stop linked to the second part.

9. Set of rings according to claim 1, said ring which has the interchangeable adapter, being capable of being pivoted relatively to said adapter when it is worn.

10. Set of rings according to claim 1, at least one pair of matching rings being mounted simultaneously onto a same adapter.

11. Set of rings according to claim 1, at least one ring being mounted onto the same adapter as a neutral counterpart.

12. Set of rings according to claim 1, each ring being provided with a raised pattern devoid of discontinuities and sharp angles allowing it to fit/abut/adjust with a single other ring of said set.

13. Set of rings according to claim 1, a radius of each ring at a level of an edge of the ring, being equal.

14. Set of rings according to claim 1, said rings being machined by chip-removal under command of a digital control.

15. Set of rings according to claim 1, each ring being provided with a certificate indicating a code allowing the ring or the matching ring to be reconstituted.

16. Set of rings according to claim 1, each ring being associated with a code defining said pattern, the code of each ring or pair of ring being different.

17. Set of rings according to claim 16, said code being used by computing device commanding a machine tool during machining of said ring.

18. The set of rings according to claim 1, wherein each ring has an outer diameter and said adapter has an outer diameter, and wherein the outer diameter of said adapter is, at most, equal to the outer diameter of the rings.

19. The set of rings according to claim 1, wherein said adapter comprises a first adapter and a second adapter, the first and second adapters being adapted to engage one another.

20. The set of rings according to claim 19, wherein said first adapter and said second adapter are threaded to engage one another.

21. The set of rings according to claim 19, the set of rings having several pairs of rings, wherein said adapter has an annular shape with an outer surface which is received within the inside diameter of the ring, said adapter further having a stop which projects outward from said outer surface, said stop having an outer diameter which is greater than the inside diameter of the ring.

22. Set of rings according to claim 1, wherein each ring of at least one pair being mounted onto adapters of different inside diameters.

23. Set of rings according to claim 22, said adapters being shaped so as to allow two matching rings to be juxtaposed without dismounting them from their adapter.

24. Set of rings according to claim 23, at least one said adapter allowing the ring mounted thereon to slide in order to check whether it matches another ring.

25. Set of rings according to claim 1, wherein said interchangeable adapters have a same outer diameter which is adapted to an inner diameter of the at least one ring.

26. Set of rings having several pairs of rings, comprising:

each ring having a pattern allowing it to be matched to a single other ring of said set, at least one of the rings in the set of several pairs of rings, having an interchangeable adapter, wherein at least a part of the interchangeable adapter is inserted inside the ring to adapt an inside diameter of the ring to the wearer's finger so that the at least one ring is individually adapted to fit the wearer's finger, and wherein each ring of at least one pair being mounted onto adapters of different inside diameters.

27. Set of rings according to claim 26, said adapters being shaped so as to allow two matching rings to be juxtaposed without dismounting them from their adapter.

28. Set of rings according to claim 27, at least one said adapter allowing the ring mounted thereon to slide in order to check whether it matches another ring.

29. Set of rings according to claim 26, wherein said interchangeable adapters have a same outer diameter which is adapted to an inner diameter of the at least one ring.

* * * * *